US011230413B2

(12) United States Patent
Farhat et al.

(10) Patent No.: US 11,230,413 B2
(45) Date of Patent: Jan. 25, 2022

(54) MICROSTRUCTURE CONNECTING MECHANISM AND PLASTIC STORAGE BAG WITH MICROSTRUCTURE CLOSURE MECHANISM

(71) Applicant: S.C. Johnson & Son, Inc., Racine, WI (US)

(72) Inventors: Hootan Farhat, Cambridge, MA (US); Mark Somers, Brighton, MA (US); Xinhua Li, Newton, MA (US); Brian Mayers, Arlington, MA (US); Olivier Schueller, Arlington, VA (US)

(73) Assignee: S.C. Johnson & Son, Inc., Racine, WI (US)

( * ) Notice: Subject to any disclaimer, the term of this patent is extended or adjusted under 35 U.S.C. 154(b) by 1521 days.

(21) Appl. No.: 14/208,429

(22) Filed: Mar. 13, 2014

(65) Prior Publication Data

US 2014/0270599 A1 Sep. 18, 2014

Related U.S. Application Data

(60) Provisional application No. 61/792,008, filed on Mar. 15, 2013.

(51) Int. Cl.

| | |
|---|---|
| ***B65D 33/25*** | (2006.01) |
| ***B65D 33/16*** | (2006.01) |
| ***B65D 33/20*** | (2006.01) |

(52) U.S. Cl.

CPC ..... *B65D 33/25* (2013.01); *B65D 33/16* (2013.01); *B65D 33/20* (2013.01); *B65D 33/255* (2013.01);

(Continued)

(58) Field of Classification Search

CPC ..... B65D 33/2558; B65D 33/255; B65D 33/2541; B65D 33/25; B65D 33/16;

(Continued)

(56) References Cited

U.S. PATENT DOCUMENTS

| | | | |
|---|---|---|---|
| 3,339,606 A | 9/1967 | Kugler | |
| 4,410,130 A | 10/1983 | Herrington | |

(Continued)

FOREIGN PATENT DOCUMENTS

| | | | |
|---|---|---|---|
| DE | 1088768 A2 * | 4/2001 | ..... B65D 33/20 |
| EP | 1088768 A2 | 4/2001 | |
| WO | WO2006/130932 A1 | 12/2006 | |

OTHER PUBLICATIONS

PCT/US2014/027384 International Search Report and Written Opinion dated Aug. 4, 2014.

(Continued)

*Primary Examiner* — Nathan J Newhouse
*Assistant Examiner* — Matthew T Theis
(74) *Attorney, Agent, or Firm* — Venable LLP

(57) ABSTRACT

A connection mechanism including a plurality of microstructure features. The connection mechanism includes a first strip, with a plurality of protrusions extending from the first strip, and a second strip, with a plurality of protrusions extending from the second strip. The protrusions define grooves between adjacent protrusions. A pressure sensitive adhesive is provided in at least some of the grooves. When the first and second strips are brought together, the protrusions from one strip are received in the grooves of the other, and some of the protrusions contact the pressure sensitive adhesive, thereby connecting the first and second strips. The connection mechanism can be used as a closure mechanism for a plastic storage bag.

23 Claims, 4 Drawing Sheets

(52) U.S. Cl.
CPC ..... *B65D 33/2508* (2013.01); *B65D 33/2541* (2013.01); *B65D 33/2558* (2013.01); *Y10T 24/33* (2015.01)

(58) Field of Classification Search
CPC ..... B65D 33/20; B65D 33/2508; Y10T 24/33; Y10T 428/28; Y10T 24/2767; Y10T 24/45152; C09J 2201/32; A61F 13/58; A44B 18/008; A44B 18/0065; A44B 18/0007; A44B 18/0049
USPC ..... 383/211; 24/304
See application file for complete search history.

(56) References Cited

U.S. PATENT DOCUMENTS 4,519,095 A 5/1985 Clayton
4,587,152 A 5/1986 Gleichenhagen et al.
4,767,220 A 8/1988 Kamp
5,088,164 A 2/1992 Wilson et al.
5,158,557 A 10/1992 Noreen et al.
5,201,101 A 4/1993 Rouser et al.
5,449,540 A 9/1995 Calhoun et al.
5,575,747 A 11/1996 Dais et al.
5,591,290 A 1/1997 Walter et al.
5,650,215 A 7/1997 Mazurek et al.
5,657,516 A 8/1997 Berg et al.
5,783,012 A 7/1998 Porchia et al.
5,791,783 A 8/1998 Porchia et al.
5,836,056 A 11/1998 Porchia et al.
6,123,890 A 9/2000 Mazurek et al.
6,149,304 A 11/2000 Hamilton et al.
6,299,966 B1 10/2001 Bonke et al.
6,315,851 B1 * 11/2001 Mazurek ..... B29C 43/222 156/231
6,440,880 B2 8/2002 Mazurek et al.
6,541,098 B2 4/2003 Venkatasanthanam et al.
6,565,697 B1 5/2003 Maercklein
6,687,962 B2 * 2/2004 Clarner ..... A44B 18/0053 24/442
6,773,647 B2 8/2004 McGuire et al.
6,838,150 B2 1/2005 Mazurek et al.
6,872,342 B2 3/2005 Giachetto et al.
6,911,243 B2 6/2005 Sher et al.
7,250,210 B2 7/2007 Mazurek et al.
7,410,298 B2 8/2008 Pawloski
7,585,111 B2 9/2009 Turvey et al.
7,674,345 B2 3/2010 Graham et al.
7,850,368 B2 12/2010 Pawloski et al.
8,110,280 B2 2/2012 Graham et al.
2003/0096108 A1 5/2003 Mussig et al.
2003/0211270 A1 11/2003 McReynolds et al.
2004/0001931 A1 1/2004 Izzi et al.
2006/0168776 A1 8/2006 Dais et al.
2009/0246478 A1 10/2009 Graham et al.
2009/0304309 A1 * 12/2009 Hayes ..... A44B 18/0053 383/63
2010/0299881 A1 * 12/2010 Borchardt ..... B65D 33/255 24/30.5 R

OTHER PUBLICATIONS

Benedek, Istvan. Pressure-Sensitive Adhesives and Applications, 2d. Ed., Feb. 3, 2004, CRC Press.
Feb. 19, 2020 Office Action in Canadian Patent Application No. 2,846,725.

* cited by examiner

MICROSTRUCTURE CONNECTING MECHANISM AND PLASTIC STORAGE BAG WITH MICROSTRUCTURE CLOSURE MECHANISM

This application claims the benefit of U.S. Provisional Patent Application No. 61/792,008, filed Mar. 15, 2013.

BACKGROUND

Field of the Invention

Our invention relates to a microstructure connecting mechanism. Our invention also relates to a plastic storage bag with a microstructure closure mechanism.

Related Art

There are many types of mechanisms for connecting two structures. In the field of flexible plastic storage bags, such as storage bags that are used to contain food, a zipper-type mechanism is often used to releasably connect the two sides of the bag about the opening to the interior of the bag. In general, a zipper-type closure mechanism for a plastic storage bag includes a projection on one side of the bag that is interlocked with a corresponding receiving member on the other side of the bag. Plastic storage bags with such a zipper closure mechanism are sold under the ZIPLOC® trademark by S.C. Johnson & Son, Inc. of Racine, Wis., and an example of a plastic storage bag with a zipper-type closure mechanism can be seen in U.S. Pat. No. 5,836,056, the disclosure of which is incorporated by reference in its entirety.

An alternative to a zipper-type closure mechanism for storage bags, or for connecting two structures in general is an adhesive-type closure mechanism. An example of an adhesive-type closure mechanism for a storage bag can be seen in U.S. Pat. No. 5,791,783, the disclosure of which is incorporated by reference in its entirety. A common problem with an adhesive-type closure mechanism is that objects sometimes stick to the adhesive area of the closure mechanism. For example, if a plastic storage bag with an adhesive-type closure mechanism is used to store food products, particles from the food may become stuck to the adhesive area when the food is inserted into and removed from the storage bag. Food stuck to the adhesive area reduces the efficacy of the adhesive-type closure mechanism. Further, the food stuck to the closure area makes the plastic storage bag look unattractive.

SUMMARY OF THE INVENTION

According to one aspect, our invention provides a connecting mechanism. The connecting mechanism includes a first strip, with a plurality of protrusions extending less than about 500 μm from the first strip, and the plurality of protrusions defining a plurality of grooves between adjacent protrusions. A pressure sensitive adhesive is provided in at least some of the grooves that are defined by the protrusions extending from the first strip. The connecting mechanism also includes a second strip. A plurality of protrusions extends less than about 500 μm from the second strip, with the plurality of protrusions defining a plurality of grooves between adjacent protrusions. The plurality of protrusions extending from the first strip are configured to be received in the grooves defined by the plurality of protrusions extending from the second strip, and the plurality of protrusions extending from the second strip are configured to be received in the grooves defined by the plurality of protrusions extending from the first strip, with the plurality of protrusions extending from the second strip contacting the pressure sensitive adhesive.

According to another aspect, our invention provides a storage bag. The storage bag includes a first side surface, and a second side surface connected to the first side surface, with the connected first and second side surfaces forming an interior of the bag with an opening to the interior. A first closure strip is provided on the first side surface adjacent to the opening of the bag. The first closure strip includes a plurality of protrusions that extends less than about 150 μm from the first strip, with the plurality of protrusions defining a plurality of grooves between adjacent protrusions, and with a pressure sensitive adhesive provided in at least some of the grooves defined between adjacent protrusions extending from the first strip. A second closure strip is provided on the second side surface adjacent to the opening of the bag, with the second closure strip including a plurality of protrusions extending less than about 150 μm from the first strip, and with the plurality of protrusions defining a plurality of grooves between adjacent protrusions. The plurality of protrusions extending from the first strip are configured to be received in the grooves defined by the plurality of protrusions extending from the second strip, and the plurality of protrusions extending from the second strip are configured to be received in the grooves defined by the plurality of protrusions extending from the first strip, with the plurality of protrusions extending from the second strip contacting the pressure sensitive adhesive to thereby seal the opening of the bag.

DETAILED DESCRIPTION OF THE INVENTION

Our invention is generally directed to a connection mechanism that includes two strips of microstructures with a pressure sensitive adhesive provided on at least one of the strips. In specific examples described herein, the connection mechanism will be described for use as a closure mechanism for plastic storage bags. The connection mechanism, however, is not limited to use with plastic storage bags. Indeed, as will be apparent from the disclosure herein, the connection mechanism has numerous applications, for example, the connection mechanism could be used as a fastener for hanging, securing, and attaching an object to another object or structure. As other examples, the connection mechanism could be used with flexible packaging, including plastic packaging, paper packaging, and other non-plastic packaging.

Figure 1:
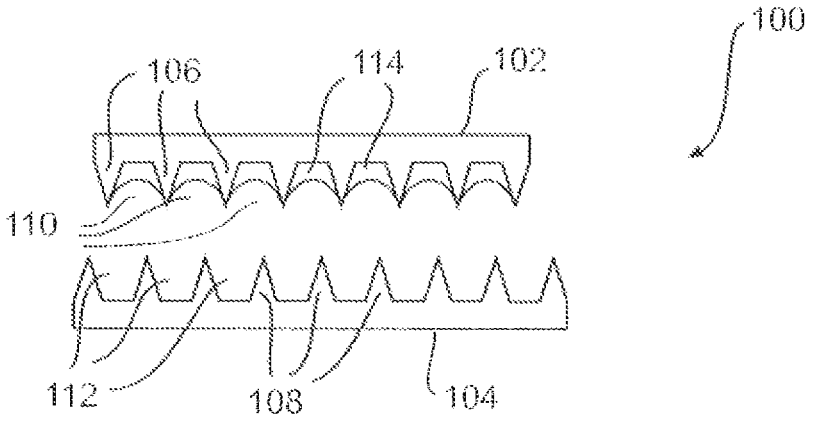
FIG. 1 is a view of a microstructure connecting mechanism according to an embodiment of the invention in a disconnected position.

FIG. 1 depicts a connection mechanism 100 according to an embodiment of the invention. The connection mechanism 100 includes first and second strips 102 and 104. A plurality of micro-scale protrusions 106 and 108 extends from the first and second strips 102 and 104. A plurality of grooves 110 and 112 is defined between adjacent protrusions 106 and 108. A pressure sensitive adhesive 114 is provided in the groves 110 of the first strip 102. The pressure sensitive adhesive 114 will be discussed in detail later in this application.

Figure 2:
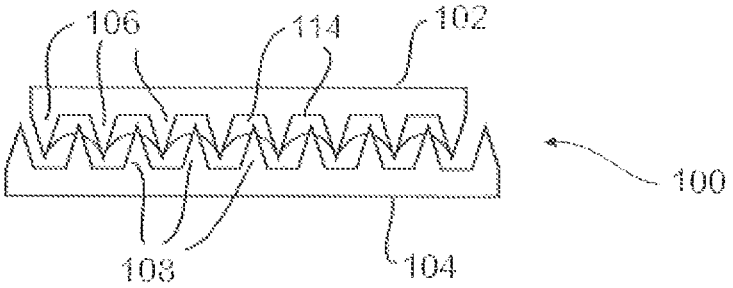
FIG. 2 is a view of the microstructure connecting mechanism shown in FIG. 1 in a connected position.

As shown in FIG. 2, the protrusions 106 of the first strip 102 are configured to be received in the grooves 112 of the second strip 104, and the protrusions 108 of the second strip 104 are configured to be received in the grooves 110 of the first strip 102. When the protrusions 108 are received in the grooves 110, the protrusions 108 contact the pressure sensitive adhesive 114. As such, the pressure sensitive adhesive 114 acts to retain the protrusions 106 in the grooves 110, i.e., to hold the strips 102 and 104 together in a connected state. As is readily apparent from this configuration, if a first structure were to be attached to the first strip 102, and a second structure were to be attached to the second strip 104, then the first and second structures will be held together by the connection mechanism 100.

The first and second strips 102 and 104 and the protrusions 106 and 108 can be made from any material that can be manipulated into the configuration of the protrusions and grooves 106, 108, 110, and 112 and retain the pressure sensitive adhesive 114. In embodiments of the invention, the strips 102 and 104 and protrusions 106 and 108 are made from thermoplastics, including, but not limited to, polyethylene (PE), polypropylene (PP), metallocene-polyethylene (mPE), low density polyethylene (LDPE), linear low density polyethylene (LLDPE), ultra-low density polyethylene (ULDPE), biaxially-oriented polyethylene terephthalate (BPET), high density polyethylene (HDPE), polyethylene terephthalate (PET), among other polyolefin plastomers and combinations and blends thereof. Notably, there is no requirement for the first and second strips 102 and 104 and the first and second protrusions 106 and 108 to be made from the same material. That is, the first and second strips 102 and 104 could be made from one material, while the first and second protrusions 106 and 108 could be made from another material. Further, the first strip 102 and first protrusion 106 could be made from one material, and the second strip 104 and the second protrusion 108 could be made from another material.

The first and second strips 102 and 104 and the first and second protrusions 106 and 108 can be manufactured using a variety of techniques. Examples of such techniques include embossing, in particular, thermal embossing, photolithography, molding, and extruding.

As part of the manufacturing technique, the surfaces of the first and second strips 102 and 104 and the surfaces of the protrusions 106 and 108 can be treated to increase functionality of the connection mechanism 100. For example, the first and second strips 102 and 104 and protrusions 106 and 108 could be subjected to plasma or corona treatment in order to facilitate the application and retention of the pressure sensitive adhesive 114. Those skilled in the art will recognize many alternative treatments that could be applied to the connection mechanism 100.

The protrusions 106 and 108 are depicted in FIG. 1 with a triangular cross section. The protrusions 106 and 108, however, may be formed in numerous alternative shapes, including trapezoids, T-shapes, pin-heads, etc. Moreover, the top surfaces of the protrusions 106 and 108 could be any shape, with examples being pointed, flat, and rounded. In fact, the only requirement with respect to their shape is that the protrusions 106 and 108 be complementary to each other, such that the protrusions 106 and 108 are able to be connected together as described above. Further aspects related to the shapes and configurations of the protrusions 106 and 108 will be discussed below.

Figure 3:
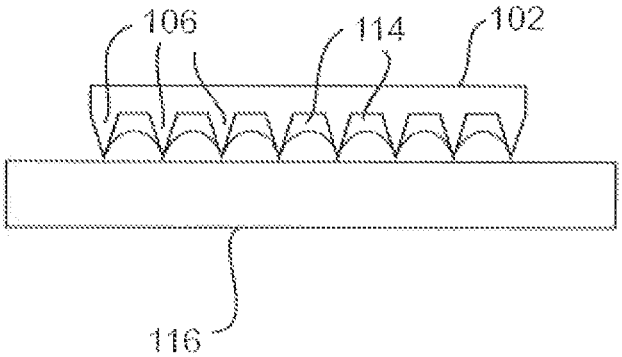
FIG. 3 is a view of one-half of the microstructure connecting mechanism contacting an object.

The pressure sensitive adhesive 114 is provided in the grooves 110 that are formed between the protrusions 106 of the first strip 102. The pressure sensitive adhesive 114 is provided to a level below the top surfaces of the protrusions 106. As shown in FIG. 3, with the pressure sensitive adhesive 114 provided only to a level below the top surfaces of the protrusions 106, the pressure sensitive adhesive will not contact an object 116 that contacts the tops of the protrusions 106, if the object is not complementary to the pattern of protrusions 106 and grooves 110. For example, if the object 116 is a user's finger, the user will not be able to perceive the pressure sensitive-adhesive 114, and thus, the first strip 102 will not feel tacky.

It should be noted that although the pressure sensitive adhesive 114 is depicted as only being provided in the grooves 110 of the first strip 102, in actuality, trace amounts of the pressure sensitive adhesive 114 may be found on the top surfaces of the protrusions 106 as a result of the process by which the pressure sensitive adhesive 114 is applied to the first strip 102. The references to the pressure sensitive adhesive 114 being contained in the grooves 110 at a level below the top surface of the protrusions 106 should be understood to mean that the pressure sensitive adhesive 114 is only substantially found within the grooves 110, such that the top surfaces of the protrusions 106 have no substantial tackiness.

It should also be noted that while the pressure sensitive adhesive 114 is only provided between the protrusions 106 on the first strip 102 in the embodiment depicted in FIG. 1, other embodiments may be configured differently. For example, a pressure sensitive adhesive can also be provided in the same manner on the second strip 104 in the grooves 112 formed between the protrusions 108. Such a two-sided application of a pressure sensitive adhesive 114 may allow for a more secure connection to be made between the first and second strips 102 and 104. Still further embodiments may provide portions of pressure sensitive adhesive on a section of one of the first and second strips 102 and 104, and provide other portions of the pressure sensitive adhesive in other sections of the other of the first and second strips 102 and 104.

A variety of pressure sensitive adhesives can be used in connection with the invention. In general, the pressure sensitive adhesive can be selected to provide the desired closing force for the connecting mechanism, i.e., provide a desired level of tightness for the connection of the first and second strips 102 and 104. The pressure sensitive adhesive can also be selected to have substantial adhesive peel strength with respect to the first and second strips 102 and 104, and protrusions 106 and 108, such that the pressure sensitive adhesive will not become disengaged from the first and second strips 102 and 104 when the first and second strips 102 and 104 are pulled apart. Of course, in this regard, the selection of the pressure sensitive adhesive will depend on the material from which the first and second strips 102 and 104 and the protrusions 106 and 108 are made.

Those skilled in the art will recognize the numerous formulations of pressure sensitive adhesives that could be used in embodiments of the invention. As one example, the pressure sensitive adhesive can be an aqueous dispersion of acrylic ester copolymer, such as PLEXTOL® D 175 manufactured by PolymerLatex GmbH of Marl, Germany. In other examples, the pressure sensitive adhesive can be a heptane or ethyl acetate-based adhesive, such as AROSET™ 1045-2-45 manufactured by the Ashland Inc. of Halethorpe, Md., a polyisobutylene rubber based adhesive such as DURO-TAK® 87-608A manufactured by Henkel AG & Co. KGaA of Düsseldorf Germany, and an acrylate based adhesive such as and DURO-TAK® 87-4098 also manufactured by Henkel AG & Co. KGaA. Further examples of pressure sensitive adhesives that can be used in embodiments of the invention can be found in Istvan Benedek, *Pressure Sensitive Adhesives and Applications* (2d ed. 2004), the disclosure of which is incorporated by reference in its entirety. The pressure sensitive adhesive can be initially applied as a solution with water or another solvent, with the solution being sprayed, dip coated, brushed, hotmelted, etc., onto the connecting mechanism 100. In short, as one having ordinary skill in the art appreciates, many adhesives are suitable for use with our invention. We prefer, however, that the adhesive be pressure sensitive, and that the pressure sensitive adhesive be an aqueous emulsion of an acrylic or an acrylic copolymer emulsion.

One aspect of our invention relates to the combination of factors that make up the configuration of the protrusions 106 and 108, and the grooves 110 and 112, of the connecting mechanism 100. There are several problems that may arise if the connecting mechanism is not correctly configured. For example, if the protrusions 106 and 108 are too narrow and the grooves 110 and 112 too wide, the protrusions 106 and 108 may bend when being contacted by a structure. The bending of the protrusions 106 and 108 could allow for contamination of the pressure sensitive adhesive provided in the grooves 110 and 112, thereby reducing, or even eliminating, the connecting functionality. On the other hand, if the protrusions 106 and 108 are too wide and the grooves 110 and 112 too narrow, it may be difficult to move the first and second strips 102 and 104 into and out of the connected state with the protrusions 106 received in the grooves 112 and the protrusions 108 received in the grooves 110. Further, it may difficult to provide the pressure sensitive adhesive in the grooves 110 and 112 if the grooves 110 and 112 are too small. If the protrusions 106 and 108 are too short (the height of the protrusions 106 and 108 being the distance that the protrusions 106 and 108 extend from the first and second strips 102 and 104), or it too much pressure sensitive adhesive is used, the pressure sensitive adhesive may contact objects that are positioned adjacent to the protrusions 106 and 108. Thus, the protrusions 106 and 108 will feel tacky to the touch. Further, shorter protrusions 106 and 108 are, in general, harder to manufacture. On the other hand, if the protrusions 106 and 108 are too tall or if the widths (or pitch) of the grooves 110 and 112 are too large, the strips 102 and 104 will not feel smooth to the touch, and it is highly desirable for the strips 102 and 104 to feel smooth, in some applications.

Still other potential considerations include the aspect ratio of the height of the protrusions 106 and 108 to the widths of the grooves 110 and 112. If the aspect ratio is too small, water may be absorbed into Ore grooves 110 and 112, which may tackify the pressure sensitive adhesive. This again will reduce the effectiveness of the connection functionality. With all of these factors in mind, there is no simple manner of optimizing a given connecting mechanism 100 configuration for a given application. Notably, many of these factors have an inverse relation to one other. One aspect of our invention has been to find certain configurations of the connecting mechanism that have outstanding functionality even in view of the countervailing factors that go into the connecting mechanism.

In embodiments of the invention, the protrusions 106 and 108, the grooves 110 and 112, and the pressure sensitive adhesive 114 may be configured as follows. The protrusions 106 and 108 may have a height of about 5 μm to about 500 μm, as measured from the surface of the first and second strips 102 and 104 to the tops of the respective protrusions 106 and 108. In specific embodiments, the protrusions have heights of about 75 μm to about 150 μm. In even more specific embodiments, the protrusions have heights of about 110 μm to about 150 μm. The widths of the top surfaces of the protrusions 106 and 108 may be less than about 200 μm, or, if desired, could even be less than about 25 μm. The widths of the bottoms of the protrusions 106 and 108, i.e., the portions of the protrusions 106 and 108 that are adjacent to the first and second strips 102 and 104, is greater than about one-fifth of the heights of the protrusions 106 and 108. The grooves 110 and 112 have a width (pitch) of about 80 μm to about 260 μm, with the groove width being measured between the tops of adjacent protrusions 106 and 108, i.e., measured from an end at the top of a protrusion, across the groove, to an corresponding end at the top of the adjacent protrusion, and not including the top surfaces of the protrusions. In a specific embodiment, the grooves have a width of 200 μm. The aspect ratio of the height of the protrusions 106 to the width of the grooves 110, and the aspect ratio of the height of the protrusions 108 to the width of the grooves 112, is preferably about 0.1 to about 2, and more preferably, about 0.3 to about 1.4. In a particular embodiment, the aspect ratio is about 0.5. The height of the pressure sensitive adhesive 114 in the grooves 110 (also referred to as the coating weight) is about one-half of the height of the protrusions. We have found that the foregoing configurations of the protrusions, grooves, and pressure sensitive adhesive provides a surprisingly good combination of properties in the connection mechanism 100, including an easy and secure connection, easy disconnection, lack of a tacky or ridged feel in the grooves 110 and 112, prevention of contamination, and hydrophobicity. At the same lime, the protrusions 106 and 108, the grooves 110 and 112, and the pressure sensitive adhesive 114 are still relatively easy to manufacture when configured in the foregoing manner.

The following are examples of particular embodiments of the connection mechanism 100. In a first particular example, the first and second strips 102 and 104 and the protrusions 106 and 108 are formed from low density polyethylene. The pressure sensitive adhesive 114 is PLEXTOL® D 175, with the pressure sensitive adhesive 114 being provided in both the grooves 110 and the grooves 112 at a coating weight of about 50 μm. The protrusions 106 and 108 have a height of about 110 μm, and the top surfaces of the protrusions have widths of about 25 μm. The grooves 110 and 112 have a width (pitch) of about 175 μm (as measured between the tops of adjacent protrusions).

In another particular example, the first and second strips 102 and 104 are formed from polypropylene, and the pressure sensitive adhesive 114 is DURO-TAK® 87-4098. The pressure sensitive adhesive 114 is provided in the grooves 110 and in the grooves 112. The protrusions 106 and 108 have heights of about 20 μm, and the widths of the bottoms of the protrusions 106 and 108 are about 20 μm. With these configurations, the connection mechanism of this embodiment has short protrusions 102 and 104, and has a low protrusion height to groove width aspect ratio.

In yet another particular example, the first and second strips 102 and 104 are formed from polyethylene terephthalate (PET). The protrusions 106 extending from the first strip 102 have a triangular cross section, a height of about 200 μm, and the bottoms of the protrusions have widths of about 150 μm. The pressure sensitive adhesive 114 is PLEXTOL® D, and the pressure sensitive adhesive 114 is provided in the grooves 110 between the protrusions 106, but the pressure sensitive adhesive 114 is not provided in the grooves 112 between the protrusions 108. The protrusions 108 extending from the second strip 104 have different cross-sectional shapes and configurations than those of the protrusions 106 extending from the first strip 102. The protrusions 108 have rounded top surfaces, with a radius of curvature at the tips of the protrusions 108 being about 25 μm. The bottoms of the protrusions have widths of about 100 μm.

Figure 4A:
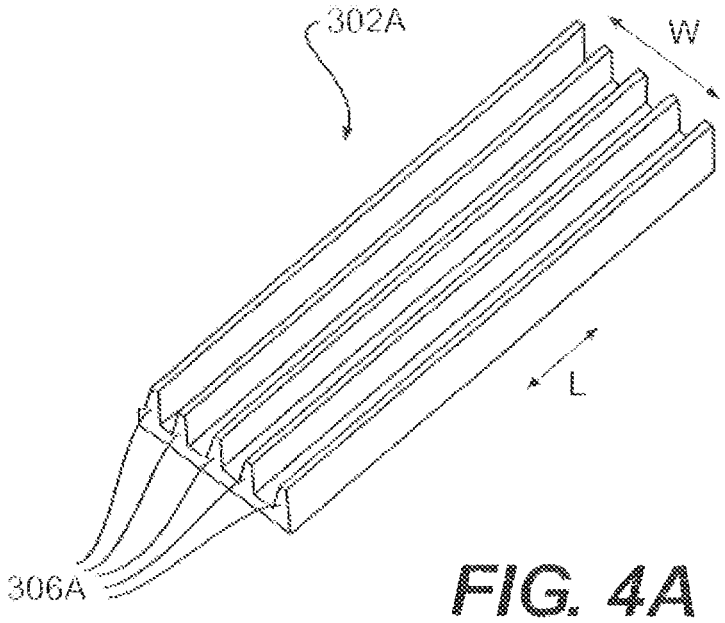
FIGS. 4A and 4B are perspective views of one side of microstructure connecting mechanisms according to embodiments of the invention.
Figure 4B:
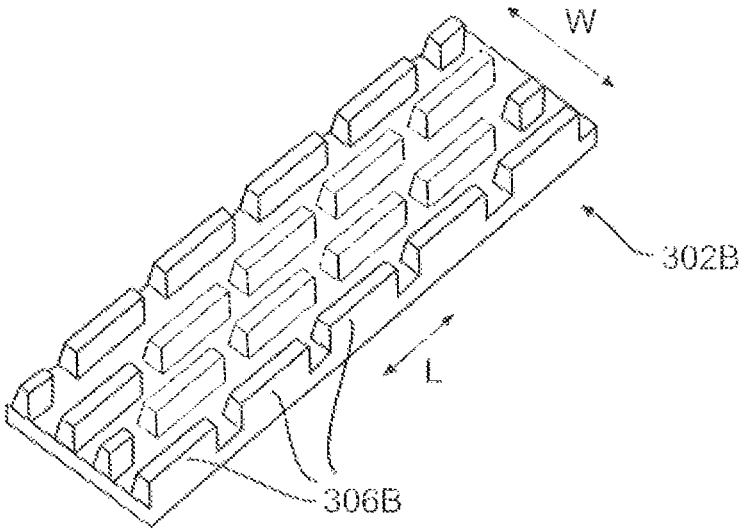

Another aspect of the configuration of the protrusions and grooves is that the pattern of protrusions and grooves can be varied in order to achieve different functionality in the connection mechanism according to the invention. The pattern of protrusions and grooves can be understood in terms of a "protrusion density." FIG. 4A shows an example of one hundred percent protrusion density along the length of a strip 302A, meaning that the protrusions 306A extend continuously across the length L of the strip 302A. FIG. 1B, on the other hand, shows an example of less than one hundred percent protrusion density along the length L of the strip 302B, in that the protrusions 306B are discontinuous, with grooves 308B provided along the lengths of the protrusions 306B. Of course, the strips 302A and 302B also have a protrusion density along their widths W as grooves 309A and 309B are formed between the protrusions 306B along the widths of the strips 302A and 302B.

Figure 5A:
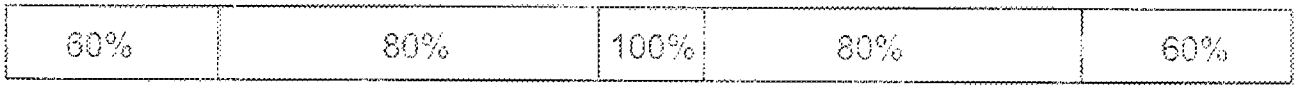
FIGS. 5A, 5B, 5C, and 5D are schematic diagrams demonstrating protrusion densities for microstructure connecting mechanisms according to embodiments of the invention.
Figure 5B:
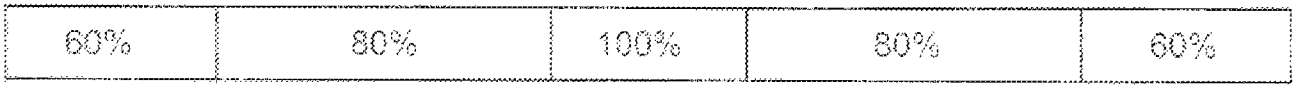
Figure 5C:
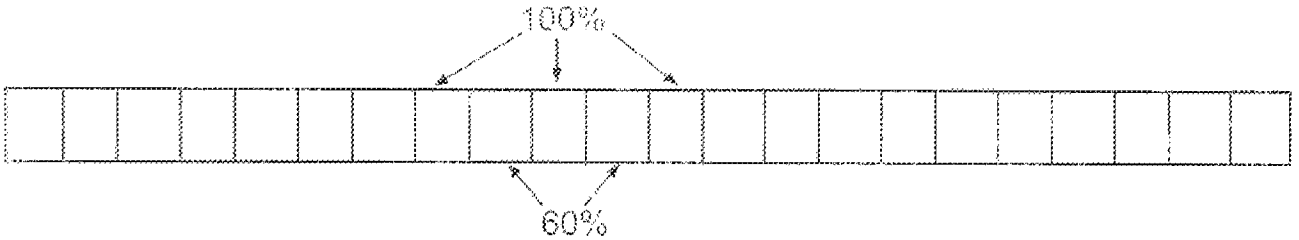
Figure 5D:
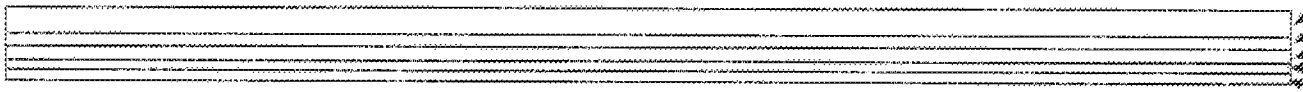

FIGS. 5A to 5D are schematic diagrams showing different patterns of protrusion densities. The patterns shown in FIGS. 5A to 5C represent different protrusion densities across the lengths of connecting mechanisms according to the invention, while the pattern shown in FIG. 5D represents different protrusion densities across the width of a connecting mechanism. We have found that, in general, the force required to connect the two sides of a connecting mechanism according to the invention can be adjusted by adjusting the pattern of the protrusion density in the connecting mechanism. In particular, the strength of the connection between the two strips of a connection mechanism according to the invention can be increased by increasing the protrusion density. As indicated by FIGS. 4A, 4B, and 5A to 5D, the protrusion density could be adjusted by varying the protrusion density along the length of the strips, or by varying the protrusion density along the widths of the strips, or by varying the protrusion density along both the lengths and the widths of the strips.

The strength of a connection between the first strip 102 and the second strip 104 can be quantified using a T-peel test, which is similar to ASTM D1876. In the T-peel test, two strips of a given width are pressed together and then pulled apart at a constant speed, with the grooves of the strips being oriented perpendicular to the peeling direction. The peel strength is the measured force that is required to pull the strips apart per unit width of the strips. In embodiments of the invention, the peel strength of the connection mechanism 100 is about 0.1 N/cm to about 12 N/cm, and in more specific embodiments, about 1 N/cm to about 6 N/cm.

Figure 6:
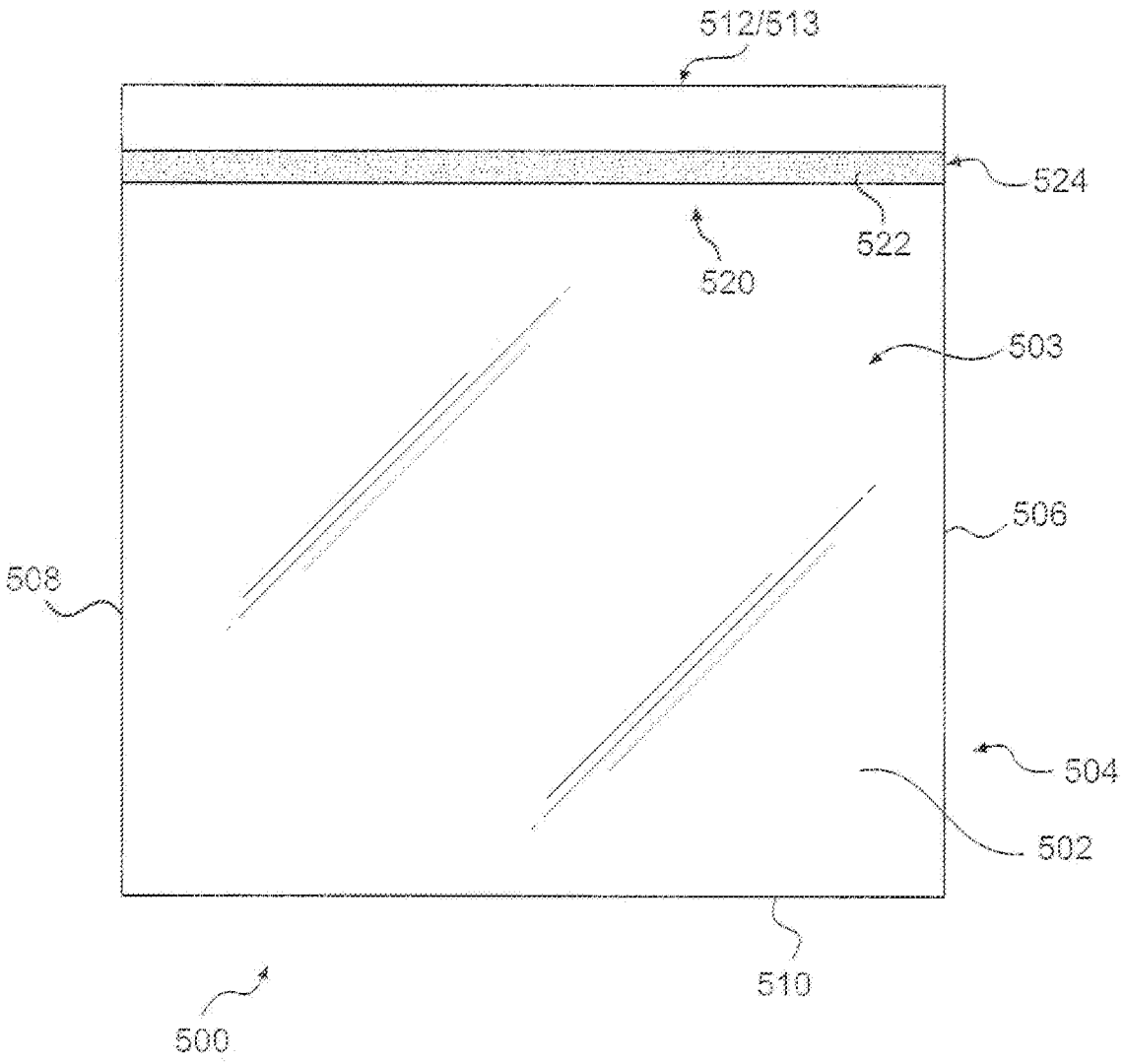
FIG. 6 is a side view of a bag with a microstructure closure mechanism according to an embodiment of the invention.

Another aspect of our invention is directed to a plastic storage bag that includes a microstructure closure mechanism. FIG. 6 depicts an example of a plastic storage bag 500 according to such an embodiment of the invention. The bag 500 includes a first side 502 and a second side 504. The first and second sides 502 and 504 are connected along edges 506 and 508, and the first and second sides 502 and 504 are also connected at a bottom edge 510 of the bag 500. An opening 503 to the interior of the bag 500 is formed adjacent to the edges 512 and 513.

The bag 500 includes a closure mechanism 520 that is configured in the manner of the microstructure connecting mechanism 100 described above. The closure mechanism 520 includes a first closure strip 522 that is positioned on the first side 502 of the bag 500 and a second closure strip 524 that is positioned on the second side 504 of the bag 500. The first and second closure strips 522 and 524 include complementary protrusions and grooves (not shown), with a pressure sensitive adhesive (not shown) provided in at least some of the grooves, as generally described above in conjunction with the microstructure connection mechanism 100. As the first and second closure strips 520 and 522 are positioned adjacent to the opening 503 of the bag 500, connecting the first and second closure strips 520 and 522 seals the opening 503 in the bag 500 in the same manner as does a conventional zipper-type closure mechanism. In embodiments of the invention, the closure strips 520 and 522 are about 8 mm to about 10 mm wide, as this generally corresponds to the size of a finger of a user.

The first and second closure strips 520 and 522 may be integrally formed with the sides 502 and 504 of the bag 500. Alternatively, the first and second closure strips 520 and 522 may be separately formed and then attached to the sides 502 and 504 of the bag 500. In specific embodiments of the invention, the sides 502 and 504 and the first and second closure strips 520 and 522 are formed from polyethylene. When both the sides 502 and 504 and the first and second closure strips 520 and 522 are formed from the same material, such as polyethylene, a tight seal can be formed at the edges 506 and 508 of the bag 500 in the area of the first and second closure strips 520 and 522.

As will be appreciated by those skilled in the art, external opening force is a measure of the force required to open a plastic storage bag when the force is applied to the outside of the bag, and internal opening force (also referred to as burst strength) is the force required to open a plastic storage bag when the force is exerted from the inside of the bag. Further discussion of opening forces for plastic storage bags can be found in U.S. Pat. Nos. 4,767,220; 5,791,783; 7,410,298; 7,585,111; and 7,850,368, the disclosures of which are incorporated by reference in their entirety. As described in detail above, the configuration of microstructure closure mechanism according to the invention provides a secure connection between the two sides of the closure mechanism. As such, the first and second closure strips 520 and 522 of the bag 500 provide for good external and internal closing forces in the bag 500. With respect to the external opening force, this force can be expressed in units of force per unit area of closure structure, i.e., force per unit area of the first and second closure strips 520 and 522. In specific embodiments of the invention, the first and second closure strips 520 and 522, when the first and second closure strips are 10 mm wide, provide an external closure force of about 0.5 N to about 30 N, and in more specific embodiments, the first and second closure strips 520 and 522 provide an external closure force of about 2 N to about 15 N. These ranges of external closure force are achieved by providing the protrusions, grooves, pressure sensitive adhesive, and adhesive coating weight in the closure strips 520 and 522 in the configurations described above. And, with these ranges of external closure force, the closure strips 520 and 522 provide an excellent seal for the bag 500, while still allowing for the strips 520 and 522 to be separated to unseal the bag 500 when so desired.

In embodiments of the invention, the first and second closure strips 520 and 522 may be formed in different colors in order to provide a visual indication that the bag 500 is sealed. More specifically, the colors of the first and second closure strips 520 and 522 are selected such that the first and second closure strips 520 and 522 appear as different colors when separated, but when the strips 520 and 522 are brought together in the connected arrangement, the connected strips 520 and 522 appear as a visually distinct third color. In alternative embodiments, the first and second closure strips 520 and 522 can appear to be at least partially opaque when separated, but then appear more clear when the first and second closure strips 520 and 522 are brought together. As such, a user can understand when the bag 500 is sealed and unsealed by the closure strips 520 and 522.

The bag 500, including the microstructured closure strips 520 and 522, presents an attractive product to a consumer. When configured in the manner described above, during normal use, the consumer will nor be able to feel the tackiness of the pressure sensitive adhesive in the first and second closure strips 520 and 522. Nor will the consumer substantially perceive the ridged protrusions and groove structure of the closure strips 520 and 522. Thus, the closure strips 520 and 522 will seem to be smooth surfaces on the bag 500. The first and second closure strips 520 and 522, however, will be capable of effectively sealing the opening 503 of the bag. Further, the first and second closure strips 520 and 522 will be less susceptible to contamination from particles, such as particles from a product being inserted into the bag 500, than with conventional adhesive-type closure mechanisms.

Although this invention has been described in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

INDUSTRIAL APPLICABILITY

The closure mechanism described herein has numerous applications, with one example being use in the commercial production of storage bags. Such storage bags have a wide variety of uses, such as being utilized to store food, chemicals, or other substances.

We claim:

1. A connecting mechanism comprising:

a first strip that is substantially planar;

a plurality of protrusions extending from a surface of the first strip, the protrusions extending a distance of less than about 500 μm from the surface of the first strip, and the plurality of protrusions defining a plurality of grooves between adjacent protrusions;

a pressure sensitive adhesive provided in at least some of the grooves that are defined by the protrusions extending from the first strip;

a second strip that is substantially planar; and a plurality of protrusions extending from a surface of the second strip, the protrusions extending a distance of less than about 500 μm from the surface of the second strip, and the plurality of protrusions defining a plurality of grooves between adjacent protrusions, wherein the plurality of protrusions extending from the first strip are configured to be received in the grooves defined by the plurality of protrusions extending from the second strip, and wherein, when the first and second strips are connected together, the plurality of protrusions extending from the surface of the second strip is received in the grooves defined by the plurality of protrusions extending from the surface of the first strip, with the plurality of protrusions extending from the surface of the second strip contacting the pressure sensitive adhesive.

2. The connecting mechanism according to claim 1, wherein the plurality of protrusions extends about 75 μm to about 150 μm from the surface of the first strip, and wherein the plurality of protrusions extends about 75 μm to about 150 μm from the surface of the second strip.

3. The connecting mechanism according to claim 1, wherein an aspect ratio of the height of the plurality of protrusions extending from the surface of the first strip to the width of the grooves defined by the plurality of protrusions extending from the surface of the first strip is about 0.3 to about 1.4, and wherein an aspect ratio of the height of the plurality of protrusions extending from the surface of the second strip to the width of the grooves defined by the plurality of protrusions extending from the surface of the second strip is about 0.3 to about 1.4.

4. The connecting mechanism according to claim 1, wherein the widths of top surfaces of the plurality of protrusions extending from the surface of the first strip are less than about 175 μm, and wherein the widths of top surfaces of the plurality of protrusions extending from the surface of the second strip are less than about 175 μm.

5. The connecting mechanism according to claim 4, wherein the widths of the top surfaces of the plurality of protrusions extending from the surface of the first strip are less than about 25 μm, and wherein the widths of the top surfaces of the plurality of protrusions extending from the surface of the second strip are less than about 25 μm.

6. The connecting mechanism according to claim 1, wherein the grooves defined by the plurality of protrusions extending from the surface of the first strip have a length of about 80 μm to about 260 μm, as measured between adjacent protrusions, and wherein the grooves defined by the plurality of protrusions extending from the surface of the second strip have a length of about 80 μm to about 260 μm, as measured between adjacent protrusions.

7. The connecting mechanism according to claim 1, wherein the pressure sensitive adhesive provided in the grooves extending from the surface of the first strip extends to points that are about one-half of the distance that the protrusions extend from the surface of the first strip.

8. The connecting mechanism according to claim 1, further comprising a pressure sensitive adhesive provided in the grooves defined by adjacent protrusions extending from the surface of the second strip.

9. The connecting mechanism according to claim 1, wherein the pressure sensitive adhesive is an aqueous emulsion of an acrylic or an acrylic copolymer emulsion.

10. The connecting mechanism of according to claim 1, wherein a density of the plurality of protrusions extending from the surface of the first strip varies along at least one of a length of the first strip and a width of the first strip, and wherein a density of the plurality of protrusions extending from the surface of the second strip varies along at least one of a length of the second strip and a width of the second strip.

11. A storage bag comprising:

a first side surface;

a second side surface connected to the first side surface, the connected first and second side surfaces forming an interior of the bag with an opening to the interior; and a first closure strip that is substantially planar and is provided on the first side surface adjacent to the opening of the bag, the first closure strip including a plurality of protrusions extending from a surface of the first strip, the protrusions extending a distance of less than about 500 μm from the surface of the first strip, and the plurality of protrusions defining a plurality of grooves between adjacent protrusions, with a pressure sensitive adhesive provided in at least some of the grooves defined between adjacent protrusions extending from the first strip; and a second closure strip that is substantially planar and is provided on the second side surface adjacent to the opening of the bag, the second closure strip including a plurality of protrusions extending from a surface of the second strip, the protrusions extending a distance of less than about 500 μm from the surface of the second strip, and the plurality of protrusions defining a plurality of grooves between adjacent protrusions, wherein, when the first and second closure strips are connected, the plurality of protrusions extending from the surface of the first strip is configured to be received in the grooves defined by the plurality of protrusions extending from the surface of the second strip, and the plurality of protrusions extending from the surface of the second strip is configured to be received in the grooves defined by the plurality of protrusions extending from the surface of the first strip, with the plurality of protrusions extending from the surface of the second strip contacting the pressure sensitive adhesive to thereby seal the opening of the bag.

12. The storage bag according to claim 11, wherein the plurality of protrusions extends about 75 μm to about 150 μm from the surface of the first closure strip, and wherein the plurality of protrusions extends about 75 μm to about 150 μm from the surface of the second closure strip.

13. The storage bag according to claim 11, wherein an aspect ratio of the height of the plurality of protrusions extending from the surface of the first closure strip to the width of the grooves defined by the plurality of protrusions extending from the surface of the first closure strip is about 0.3 to about 1.4, and wherein an aspect ratio of the height of the plurality of protrusions extending from the surface of the second closure strip to the width of the grooves defined by the plurality of protrusions extending from the surface of the second closure strip is about 0.3 to about 1.4.

14. The storage bag according to claim 11, wherein the widths of top surfaces of the plurality of protrusions extending from the surface of the first closure strip are less than about 175 μm, and wherein the widths of top surfaces of the plurality of protrusions extending from the surface of the second closure strip are less than about 175 μm.

15. The storage bag according to claim 14, wherein the widths of the top surfaces of the plurality of protrusions extending from the surface of the first closure strip are less than about 25 μm, and wherein the widths of the top surfaces of the plurality of protrusions extending from the surface of the second closure strip are less than about 25 μm.

16. The storage bag according to claim 11, wherein the grooves defined by the plurality of protrusions extending from the surface of the first closure strip have a length of about 80 μm to about 260 μm, as measured between adjacent protrusions, and wherein the grooves defined by the plurality of protrusions extending from the surface of the second closure strip have a length of about 80 μm to about 260 μm, as measured between adjacent protrusions.

17. The storage bag according to claim 11, wherein the pressure sensitive adhesive provided in the grooves extending from the surface of the first closure strip extends to points that are about one-half of the distance that the protrusions extend from the surface of the first closure strip.

18. The storage bag according to claim 11, further comprising a pressure sensitive adhesive provided in the grooves defined by adjacent protrusions extending from the surface of the second closure strip.

19. The connecting mechanism of claim 11, wherein the pressure sensitive adhesive is an aqueous emulsion of an acrylic or an acrylic copolymer emulsion.

20. The storage bag according to claim 11, wherein the first closure strip and the second closure strip provide an external opening force of about 0.5 N to about 30 N.

21. The storage bag according to claim 11, wherein the first closure strip appears as a first color and the second closure strip appears as a second color when the first and second closure strips are separated, and wherein the first closure strip and the second closure strip appear as a third color when the first and second closure strips are connected together.

22. The storage according to claim 11, wherein a density of the plurality of protrusions extending from the surface of the first closure strip varies along at least one of a length of the first closure strip and a width of the first closure strip, and wherein the density of the plurality of protrusions extending from the surface of the second closure strip varies along at least one of a length of the second closure strip and a width of the second closure strip.

23. A connecting mechanism comprising:

a first strip that is substantially planar;

a plurality of protrusions extending from a surface of the first strip, the protrusions extending a distance of less than about 500 μm from the surface of the first strip, and the plurality of protrusions defining a plurality of grooves between adjacent protrusions;

a pressure sensitive adhesive provided in grooves that are defined by the protrusions extending from the first strip, the pressure sensitive adhesive being provided from a position adjacent to one end of the first strip to a position adjacent to a second end of the first strip;

a second strip that is substantially planar; and a plurality of protrusions extending from a surface of the second strip, the protrusions extending a distance of less than about 500 μm from the surface of the second strip, and the plurality of protrusions defining a plurality of grooves between adjacent protrusions, wherein the plurality of protrusions extending from the first strip are configured to be received in the grooves defined by the plurality of protrusions extending from the second strip, and wherein, when the first and second strips are connected together, the plurality of protrusions extending from the surface of the second strip is received in the grooves defined by the plurality of protrusions extending from the surface of the first strip, with the plurality of protrusions extending from the surface of the second strip contacting the pressure sensitive adhesive.

* * * * *